United States Patent [19]

Arase et al.

[11] 4,146,398

[45] Mar. 27, 1979

[54] COLOR PHOTOGRAPHIC MATERIAL COMPRISING ACID-TREATED GELATIN

[75] Inventors: Haruo Arase; Kenichi Yabuuchi, both of Nagaokakyo, Japan

[73] Assignee: Mitsubishi Paper Mills, Ltd., Tokyo, Japan

[21] Appl. No.: 503,510

[22] Filed: Sep. 5, 1974

[51] Int. Cl.[2] ..... G03C 1/76; G03C 3/00; G03C 1/86; G03C 1/78

[52] U.S. Cl. ..... 96/74; 96/67; 96/85; 96/87 R

[58] Field of Search ..... 96/114, 7, 67, 88, 74, 96/85, 87 R; 260/118

[56] References Cited

U.S. PATENT DOCUMENTS

| | | | |
|---|---|---|---|
| 2,322,027 | 6/1943 | Jelley et al. | 96/74 X |
| 3,434,837 | 3/1969 | Knott et al. | 96/74 |
| 3,676,141 | 7/1972 | Hara et al. | 96/100 |
| 3,850,640 | 11/1974 | Babbitt et al. | 96/67 |

*Primary Examiner*—J. Travis Brown
*Assistant Examiner*—L. Falasco
*Attorney, Agent, or Firm*—Cushman, Darby & Cushman

[57] ABSTRACT

Acid-treated gelatin having a jelly strength of at least 250 g (in bloom) is added to silver halide emulsion layers, ultraviolet absorber layer, etc. which are coated on a resin coated paper and which contain high boiling point solvent, whereby deterioration of physical properties of surface of the photographic paper can be prevented.

5 Claims, No Drawings

COLOR PHOTOGRAPHIC MATERIAL COMPRISING ACID-TREATED GELATIN

The present invention relates to a color photographic material having a paper both sides of which are coated with polyolefins (i.e. a resin coated paper which is referred to as RC paper hereinafter) as a support. More particularly, it relates to a color photographic material comprising a RC paper as a support and gelatin silver halide emulsions which are obtained by dissolving each of yellow, magenta and cyan couplers in high boiling point solvents (boiling point higher than 175° C.) referred to hereinafter, dispersing each solution in protective colloids such as gelatin in which silver halide is dispersed and which are coated on said support.

In general, the so-called protected coupler type (referred to as PC type hereinafter) color photographic papers which use silver halide emulsions prepared by dissolving a coupler in a high boiling point solvent, and dispersing the solution in gelatin have the merits that the color images are hard to be faded and have a high sharpness, but also have the following demerits. That is, the high boiling point solvents have limitation in solubility for couplers and generally the following are considered suitable: dibutyl phthalate, dihexyl phthalate, dioctyl phthalate, dinonyl phthalate, diisononyl phthalate, tributyl phosphate, tricresyl phosphate, diethyl succinate, 2-monoethyldiphenyl, butyl stearate, butyl benzoate, dibutyl maleate, dioctyl maleate, methyl salicylate, isoamyl salicylate, isosafrole, etc. However, these solvents give adverse effects on physical properties of the usual gelatin which is used most often as protective colloid. For example, these solvents cause reduction in setting point of gelatin and jelly strength of gelatin, due to which setting ability of the photographic emulsions with cold air (usually lower than 10° C.) is reduced in coating, and under some drying conditions of the photographic emulsions the coating layers are caused to be loosening during drying, and furthermore development after drying causes "reticulation" of the gelatin film layers which results in matting phenomenon to lose luster of the surface. These are significant disadvantages in quality of PC type color photographic paper using the RC paper as a support. In the case of using baryta paper as a support, the beautiful lustrous surface can be obtained by the so-called ferrotype drying after development, i.e., by allowing the emulsion film layers containing water to contact with a smooth metal plate with heat. On the other hand, in the case of using RC paper as a support, since the surfaces of this RC paper are coated with a polyolefin (usually polyethylene), there is no gas permeability between the top surface and the back surface and so the ferrotype drying cannot be applied. Therefore, it is usual to dry the coated photographic emulsion by blowing thereto a hot air at 40° to 80° C. or by spontaneously drying by suspending it in a room. In this case, to obtain the surface with beautiful mirror luster, it is necessary that not only the RC paper used as a support has a smooth surface, but also the surface of the silver halide emulsion layers applied on the support can maintain a high smoothness at drying after development.

However, the PC type color photographic emulsion containing the high boiling point solvent is inferior to the emulsions not containing any high boiling point solvent in physical properties at the gelled state. Therefore, in the case of employing a high temperature and high speed drying which is required for promotion and simplification of coating and drying of the emulsions, the emulsion layer gelled with a cold air in a setting zone tends to result in collapse of its gel structure in the subsequent warm air drying zone (usually 30° to 60° C.). Thus the dried emulsion layer with the gel structure collapsed tends to be "over-swelling" at the development process to bring about the so-called "reticulation" phenomenon which forms creases on the surface of the layer. The emulsion layer in which the reticulation phenomenon has occurred cannot be subjected to ferrotype drying. Therefore, the creases remain as irregularities on the surface after drying, whereby uniform smoothness is lost and beautiful mirror luster cannot be obtained.

The inventors have made intensive researches in an attempt to overcome the defects as mentioned above and have found that when a part or all of the usual lime-treated gelatin which is a protective colloid for the high boiling point solvent-containing layer, namely, a layer of dispersion of a coupler, an ultraviolet absorber and other oil-soluble materials in the high boiling point solvent is substituted with an acid-treated gelatin having a jelly strength of at least 250 g [measured by PAGGI method, namely, it was decided by the Commission on Testing Methods for photographic Gelatin of JAPAN in 1969 and the measurement condition of which was followed: the jelly cup containing 120 ml of 6⅔ wt.% gelatine solution to be tested is kept in the water bath at 10 ± 0.1° C. for 16 to 18 hours and the jelly strength can be measured by using "Bloom Gelometer" after cooling the sample], or a suitable amount of said acid-treated gelatin is used as a binder of a protective layer provided on said high boiling point solvent containing layer, said defects can be overcome effectively.

In general, the acid-treated gelatin (also called acidic gelatin) is superior in physical properties to lime-treated gelatin (also called alkali-treated gelatin or lime-dipped gelatin) and especially the gelatin having a jelly strength of at least 250 g cannot be obtained by lime-treatment. According to the present invention, with use of acid-treated gelatin having a jelly strength of at least 250 g, physical properties of the emulsion layer gelled with a cold air in the setting zone can be improved to prevent collapse of gel structure of the layer in the subsequent warm air zone, whereby it becomes possible to speed-up the coating and drying step, to prevent reticulation of the emulsion surface during development and to obtain the smooth surface having an excellent mirror luster after drying. Gelatins having a jelly strength of less than 250 g are inferior in said effects.

Said effect is conspicuously high when the acid-treated gelatin is added in an amount of at least 30%, preferably at least 50% of the total amount of the used gelatin in the high boiling point solvent containing layer. When the acid-treated gelatin is used in a layer not containing any high boiling point solvent (such as an intermediate layer, protective layer, etc.), addition of at least 10%, preferably at least 30% per total amount of gelatin in said layer can result in sufficient effect. Amount of the acid-treated gelatin used may vary depending upon kind and amount of the high boiling point solvent used.

The effect of the present invention can be attained by using the acid-treated gelatin having a jelly strength of at least 250 g in at least one layers in the case of multilayer color photosensitive materials. The more the number of layers in which the acid-treated gelatin is used is, the higher the effect is and the highest effect is obtained when the acid-treated gelatin is used in all layers. When the number of layers in which the acid-treated gelatin is used is small, it is preferred that the acid-treated gelatin is used in an amount of as much as possible in possible upermost layer containing high boiling point solvent. On the other hand, when the acid-treated gelatin is used in many layers, amount of the acid-treated gelatin used in each layer may be relatively small.

Examples of polyolefins coated on paper used in the present invention are polyethylene, polypropylene, polyisobutylene, ethylene-propylene copolymer, ethylene-butylene copolymer, etc.

The present invention may be applied to not only the PC type color photographic paper, but to general photographic papers comprising RC paper on which a high boiling point solvent containing emulsion in which chemicals (such as developer, anti-oxidant, etc.) are dissolved is coated.

The present invention will be illustrated in the following Examples which do not limit the present invention.

EXAMPLE 1

On a paper both sides of which were coated with polyethylene and which was subjected to corona discharge to increase adhesion to emulsion layer were coated a blue sensitive silver halide emulsion (I) prepared by dissolving a yellow coupler in dibutyl phthalate and dispersing it in gelatin by high speed agitation, a green sensitive silver halide emulsion (II) prepared by dissolving a magenta coupler in tricresyl phosphate and dispersing it in gelatin, an intermediate layer (III) prepared by dissolving the ultraviolet absorber "Tinuvin-PS" and dispersing it in gelatin, a red sensitive silver halide emulsion (IV) prepared by dissolving a cyan coupler in dinonyl phthalate and dispersing it in gelatin and a protective layer (V) as shown in Table 1. In these layers, acid-treated gelatin was used at the proportions as shown in Table 1 and usual lime-treated gelatin (having a jelly strength of less than 250 g) was used for the remainder.

The layers (I) to (V) were coated at a coating speed of 25 m/min and set with a cold air at 0° C., and dried in the first warm air zone at 38° C. and in the second warm air zone at 55° C. to obtain a color photographic paper. For comparison, in the same manner as mentioned above except that the acid-treated gelatin was replaced with lime dipped gelatin (having a jelly strength of less than 250 g), emulsion layers, ultraviolet absorber layer and protective layer were coated on the support and were dried under the same conditions as mentioned above. These photographic papers were subjected to a developing treatment at 33° C. for 4 minutes, a bleaching and fixing treatment at 33° C. for 3 minutes, a water washing at 20° C. for 1 minute, a stabilizing treatment at 33° C. for 1 minute and then dried with hot air at about 55° C. The photographic paper which used the acid-treated gelatin had a beautiful smooth and lustrous surface while the photographic paper which did not use the acid-treated gelatin had matted and non-lustrous surface which showed "reticulation" on the surface gelatin layer under observation by microscope.

EXAMPLE 2

On the same support as used in Example 1 were coated a blue sensitive silver halide emulsion (I) prepared by dissolving a yellow coupler in tricresyl phosphate and dispersing it in gelatin by high speed agitation, a green sensitive silver halide emulsion (II) prepared by dissolving magenta coupler in diethyl succinate and dispersing it in gelatin by high speed agitation, an intermediate layer (III) prepared by dissolving an ultraviolet absorber "Tinuvin-320" in 2-ethyldiphenyl and dispersing it in gelatin by high speed agitation and a red sensitive silver halide emulsion (IV) prepared by dissolving cyan coupler in diisonoyl phthalate and dispersing it in gelatin by high speed agitation and a protective layer (V) as shown in Table 2. In these layers, acid-treated gelatin was used at the proportion as shown in Table 2 and usual lime-treated gelatin (having a jelly strength of less than 250 g) was used for the remainder. The layers (I) to (V) were coated at a coating speed of 35 m/min and set with cold air at 0° C. and dried in the first warm air zone at 45° C. and in the second warm air zone at 55° C. to obtain the present color photographic paper. For comparison, in the same manner as mentioned above except that the acid-treated gelatin was replaced by the usual lime-dipped gelatin (having a jelly strength of less than 250 g), the emulsions, the ultraviolet absorber layer and the protective layer were coated on the same support as used above and were dried. These photographic papers were subjected to developing and drying treatments. The photographic paper which used the acid-treated gelatin had a beautiful lustrous surface while the other photographic paper which did not used the acid-treated gelatin had a matted non-lustrous surface, which showed "reticulation" on the surface gelatin layer.

Table 1

| | Layers | Kind of coupler | High boiling point solvent | Acid-treated gelatin Name | Jelly strength | Amount |
|---|---|---|---|---|---|---|
| I | Blue sensitive silver bromide emulsion layer | Yellow | Dibutyl phthalate | — | — | 0 % |
| II | Green sensitive silver chloro-bromide emulsion layer | Magenta | Tricresyl phosphate | — | — | 0 % |
| III | Ultraviolet absorber layer | Tinuvin-PS | Dinonyl phthalate | PNG | 350 | 80 % |
| IV | Red sensitive silver chloro-bromide emulsion layer | Cyan | Diononyl phthalate | PNE | 351 | 55 % |
| V | Protective layer | — | — | PNG | 350 | 100 % |

Table 2

| | Layers | Kind of coupler | High boiling point solvent | Acid treated gelatin | | |
|---|---|---|---|---|---|---|
| | | | | Name | Jelly strength | Amount |
| I | Blue sensitive silver bromide emulsion layer | Yellow | Tricresyl phosphate | PNE | 351 | 30 % |
| II | Green sensitive silver chloro-bromide emulsion layer | Magenta | Diethyl succinate | PNF | 330 | 35 % |
| III | Ultraviolet absorber layer | Tinuvin-320 | 2-Ethyldiphenyl | PNF | 350 | 85 % |
| IV | Red sensitive silver chloro-bromide emulsion layer | Cyan | Diisononyl phthalate | PNG | 351 | 55 % |
| V | Protective layer | — | — | PNG | 350 | 100 % |

Note
1. "Tinuvin-PS" and "Tinuvin-320" are trademarks for triazole type ultraviolet absorbers produced by CIBA-GEIGY Co. Ltd in Switzerland.
2. The acid-treated gelatins "PNE", "PNF" and "PNG" are trademarks for those produced by Miyagi Chemical Co. in Japan.
3. Unit for the jelly strength is gram (measured by PAGGI method with use of Bloom gelometer).
4. The amount of the acid treated gelatin is percent by weight per total amount of gelatin used.

What is claimed is:

1. A color photographic photosensitive material which comprises a support paper both sides of which are coated with polyolefin and in combination on one side of the coated paper a blue-sensitive silver halide emulsion layer, a green-sensitive silver halide emulsion layer, a red-sensitive silver halide emulsion layer, an ultraviolet absorber layer, an intermediate layer and a protective layer, at least one of said layers containing high boiling solvent and at least on of said layers containing an acid-treated gelatin having a jelly strength of at least 250 grams as measured after cooling with a Bloom Gelometer using a jelly cup containing 120 ml of 6⅔ wt % gelatin solution maintained at 10 ± 0.1° C. for 16 to 18 hours.

2. A color photographic photosensitive material according to claim 8 wherein solvent and the acid-treated gelatin are only in the layer containing high boiling point solvent, the content of the acid-treated gelatin is at least 30% of the total amount of gelatin in said layer which contains the high boiling point solvent.

3. A color photographic photosensitive material according to claim 1 wherein the acid-treated gelatin is only in a layer which does not contain high boiling point solvent and the content of the acid-treated gelatin is at least 10% of the total amount of gelatin in said layer which does not contain any high boiling point solvent.

4. A color photographic photosensitive material according to claim 1 wherein the content of acid-treated gelatin is at least 50% of the total amount of gelatin in the layer which contains the high boiling solvent.

5. A color photographic photosensitive material according to claim 1 wherein the acid-treated gelatin is contained in a layer which does not contain any high boiling solvent, said acid-treated gelatin being at least 30% of the total amount of gelatin in said layer.

* * * * *